United States Patent [19]

De Matthaeis et al.

[11] Patent Number: 5,067,658

[45] Date of Patent: Nov. 26, 1991

[54] DIESEL ENGINE ELECTROMAGNETIC FUEL INJECTOR

[75] Inventors: Sisto L. De Matthaeis, Modugno; Mario Sfarzetta, Palo Del Colle, both of Italy

[73] Assignee: Weber S.r.l., Turin, Italy

[21] Appl. No.: 485,574

[22] Filed: Feb. 27, 1990

[30] Foreign Application Priority Data

Feb. 28, 1989 [IT] Italy ..... 67134A/89

[51] Int. Cl.[5] ..... F02M 51/00

[52] U.S. Cl. ..... 239/533.8; 239/585; 123/446; 251/129.01

[58] Field of Search ..... 239/533.8, 533.9, 533.10, 239/533.11, 533.12, 585, 88, 124, 96, 533.2, 533.3; 123/496, 446; 251/129.01, 129.16

[56] References Cited

U.S. PATENT DOCUMENTS

| | | | |
|---|---|---|---|
| 3,464,627 | 9/1969 | Huber | 239/533.8 |
| 3,481,542 | 12/1969 | Huber | 239/533.8 |
| 4,382,554 | 5/1983 | Hofmann | 239/533.9 |
| 4,566,416 | 1/1986 | Berchtold | 239/533.8 |
| 4,856,713 | 8/1989 | Burnett | 239/124 |
| 4,928,888 | 5/1990 | Ricco | 239/533.8 |
| 4,946,106 | 8/1990 | Turchi et al. | 239/96 |

FOREIGN PATENT DOCUMENTS

| | | | |
|---|---|---|---|
| 3113475 | 10/1982 | Fed. Rep. of Germany | 239/533.9 |

*Primary Examiner*—Andres Kashnikow
*Assistant Examiner*—Christopher G. Trainor
*Attorney, Agent, or Firm*—Baker & Daniels

[57] ABSTRACT

An injector comprising a plunger for controlling fuel passage between an injection chamber and at least an injection orifice formed in an injection nozzle; and an electromagnetic fuel metering valve for controlling fuel passage through a drain orifice between a control chamber, supplied with fuel under pressure, and a low-pressure chamber, so as to reduce the fuel pressure in the control chamber to a given value and so displace the plunger; characterised by the fact that pressurized fuel is supplied to the injection chamber and control chamber by means of a single fitting connected to a supply pipe and coming out inside a supply orifice formed in the injector body and communicating with the control chamber and a duct for supplying fuel to the injection chamber.

5 Claims, 1 Drawing Sheet

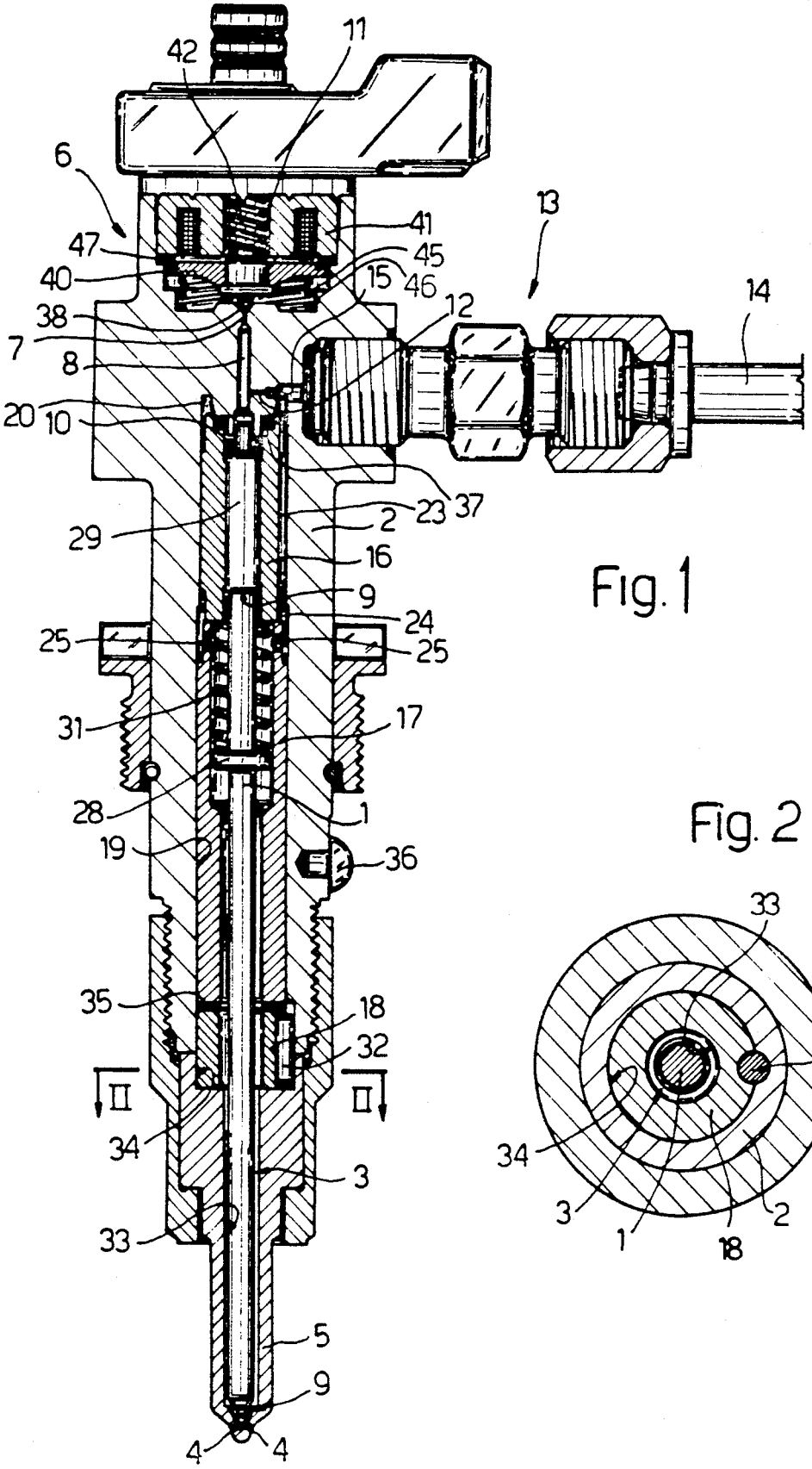
Fig. 1
Fig. 2
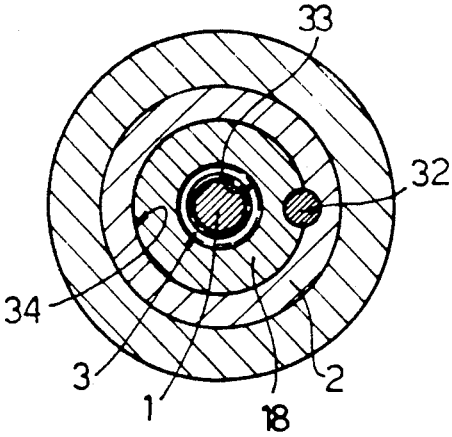

DIESEL ENGINE ELECTROMAGNETIC FUEL INJECTOR

BACKGROUND OF THE INVENTION

The present invention relates to a Diesel engine electromagnetic fuel injector of straightforward, compact design and a high degree of reliability.

Injectors of this type usually comprise a plunger sliding inside the injector body, for controlling fuel passage between an injection chamber, supplied with fuel under pressure, and at least one injection orifice formed in an injection nozzle secured to the body; and an electromagnetic fuel metering valve for controlling fuel passage through a drain orifice between a control chamber, supplied with fuel under pressure, and a low-pressure chamber, and reducing the pressure of the fuel in said chamber by draining the same through said orifice.

Appropriate surface portions of the plunger are exposed to the fuel inside the injection and control chambers, so that the pressures inside the same and exerted on said surface portions raise the plunger when the pressure inside the control chamber falls to a given value, thus enabling fuel supply through the injection orifices on the nozzle.

Injectors of the type briefly described above present a number of drawbacks.

Firstly, they are extremely complex in design and of large size, particularly radially. In fact, for feeding pressurized fuel into the control and injection chambers, two separate fittings are provided, each connected to a respective delivery line. Moreover, two ducts are required inside the injector for respectively connecting said fittings to the injection and control chambers. As a result of the injection chamber being located at the bottom of the injector, the first of said ducts is extremely long and comprises a number of portions formed in various parts of the injector. For forming both said ducts, therefore, numerous holes and cavities must be formed inside the injector body and connected members. Moreover, additional holes must be provided for housing the plunger, some of which must be appropriately ground for ensuring correct guiding of the plunger during its movement.

A further drawback of injectors of the aforementioned type is that they fail to provide for accurate metering of the fuel, especially when operated frequently. This is often caused by malfunctioning of the fuel metering valve as a result of incorrect operation of the anchor forming part of the valve and controlling displacement of the plugging member on the same. Said anchor, in fact, is not always guided accurately during its movement, and often contacts the core of the electromagnet facing it.

SUMMARY OF THE INVENTION

The aim of the present invention is to provide an electromagnetic fuel injector of the type briefly described above, designed to overcome the aforementioned drawbacks, i.e. which is of straightforward, compact design, and provides for a high degree of reliability under all operating conditions.

With this aim in view, according to the present invention, there is provided a Diesel engine electromagnetic fuel injector comprising:

a plunger sliding inside the injector body, for controlling fuel passage between an injection chamber, supplied with fuel under pressure, and at least one injection orifice formed in an injection nozzle secured to said body;

an electromagnetic fuel metering valve for controlling fuel passage, through a drain orifice, between a control chamber, supplied with fuel under pressure, and a low-pressure chamber, so as to reduce the pressure of the fuel in said control chamber by draining the same through said orifice;

surface portions of said plunger being exposed to the fuel inside said injection chamber and said control chamber, so that the pressures inside said chambers and acting on said surface portions displace said plunger when the pressure in said control chamber falls to a given value;

characterised by the fact that said fuel under pressure is supplied to said injection chamber and said control chamber by means of a single fitting connected to a supply pipe and coming out inside a supply orifice formed in said body and communicating with said control chamber and with a supply duct for feeding fuel into said injection chamber.

BRIEF DESCRIPTION OF THE DRAWINGS

The present invention will be described in detail, by way of a non-limiting example, with reference to the accompanying drawings, in which:

FIG. 1 shows an axial section of the injector according to the present invention;

FIG. 2 shows a section along line II—II in FIG. 1.

DETAILED DESCRIPTION OF THE INVENTION

The injector according to the present invention substantially comprises a plunger 1 sliding inside the injector body 2, for controlling fuel passage between an injection chamber 3, located at the bottom of the injector, and the combustion chamber of a cylinder on the engine through at least one injection orifice 4 formed in an injection nozzle 5 secured to body 2.

Said injector also comprises an electromagnetic fuel metering valve 6 for controlling fuel passage through a drain orifice 7 between a control chamber 8, located at the top of the injector and supplied with fuel under pressure, and a low-pressure chamber 11.

Plunger 1 presents surface portions 9 exposed to the fuel inside injection chamber 3, and surface portions 10 exposed to the fuel inside control chamber 8. The respective pressures inside chambers 3 and 8 thus act respectively on surface portions 9 and 10 for raising plunger 1, as described later on, when the pressure inside control chamber 8 falls to a given value.

According to the present invention, pressurized fuel is fed into injection chamber 3 and control chamber 8 by means of a single fitting 13 connected to a pressurized fuel supply pipe 14. Said fitting 13 comes out inside a supply orifice 15 formed in body 2 and communicating with control chamber 8 via an orifice 12 of appropriate diameter, as shown clearly in FIG. 1. Orifice 15 also communicates with injection chamber 3 via a duct formed substantially inside two sleeves 16 and 17 housed in an axial hole 19 in body 2, which also houses a third sleeve 18. Said duct comprises an annular cavity 20 formed in the end wall of, and coaxial with, hole 19, and inside which fuel supply orifice 15 also terminates Said duct also comprises an axial groove 23 formed in top sleeve 16; an annular chamber 24 formed between sleeves 16 and 17 and hole 19; and at least a radial hole 25 formed in sleeve 17.

Plunger 1 presents a projection 28 on which rests one end of a helical spring 31 located between projection 28 and top sleeve 16 so as to normally secure the bottom end of plunger 1 against a seat on nozzle 5, thus closing injection orifices 4. A top portion 29 of plunger 1 is housed in sliding manner inside top sleeve 16 so as to guide plunger 1 as it slides longitudinally. Control chamber 8 is conveniently defined by a hole formed in body 2, coaxial with hole 19 and communicating with the same as shown in FIG. 1. The diameter of the hole defining control chamber 8 is considerably smaller than that of hole 19, and the axis of orifice 15 is conveniently perpendicular to that of holes 8 and 19. Bottom sleeve 18 is also housed inside a cavity 34 formed in nozzle 5, which is positioned angularly in relation to body 2 by means of a radial pin 32 inserted between sleeve 18, body 2 and nozzle 5, as shown clearly in the FIG. 2 section. An elastic annular element 35 is provided between sleeves 18 and 17 for ensuring slackfree assembly. Body 2 presents a projection 36 for angularly positioning the injector on the cylinder head. Between top sleeve 16 and the end surface of hole 19, a ring 37 is provided for sealing between annular cavity 20 and control chamber 8.

Metering valve 6 substantially comprises a plugging member, consisting for example of a ball 38, for controlling fuel passage through drain orifice 7 from control chamber 8 to a low-pressure chamber 11 communicating with the same. Plugging member 38 is activated by a disc-shaped anchor 40 attracted by the core 41 of an electromagnet and loaded by a spring 42 located between core 41 and anchor 40, and exerting on anchor 40 a force in the opposite direction to that produced by the electromagnet. A further helical spring 45 is provided between anchor 40 and a surface 46 of body 2, for exerting uniform pressure on anchor 40 and so guiding the same during its movement.

Between anchor 40 and core 41, an annular spacer 47 is provided for preventing the surface of anchor 40 facing core 41 from contacting the same.

The injector according to the present invention operates as follows.

Pressurized fuel is fed along pipe 14 and through fitting 13 into supply orifice 15. A first stream of pressurized fuel is thus fed into control chamber 8 through hole 12, and a second stream into injection chamber 3 along the duct formed by annular cavity 20, axial groove 23, annular chamber 24 and radial holes 25. Surface portions 9 and 10 exposed respectively to the fuel inside injection chamber 3 and control chamber 8 are thus subjected to the respective pressures inside said chambers. When metering valve 6 is de-activated, in which case the pressure is substantially the same in both chambers 3 and 8, the resultant of the pressures acting on surface portions 9 and 10 holds the end of plunger 1 against the seats on nozzle 5, thus closing injection orifices 4.

When, on the other hand, metering valve 6 is activated, anchor 40 is attacted by core 41, thus detaching plugging member 38 from its seat; a predetermined amount of fuel is allowed to flow from control chamber 8 into low-pressure chamber 11 through orifice 7; and the pressure inside control chamber 8 drops to a given value. The resultant of the pressures acting on plunger 1 is thus reversed, thus raising plunger 1 against the elastic reaction of spring 31, and enabling a predetermined amount of fuel to be supplied through injection orifices 4 of nozzle 5.

During its movement, anchor 40 is guided by spring 45 exerting substantially uniform pressure on the periphery of anchor 40. Moreover, in the top limit position, the top surface of anchor 40 is prevented from contacting core 41 by spacer ring 47.

The injector according to the present invention is extremely straightforward in design and requires no complicated, intricate mechanical machining for its manufacture. Body 2, in fact, need simply be provided with orifice 15 and holes 8 and 19, while the duct connecting supply orifice 15 with injection chamber 3 is formed substantially inside sleeves 16 and 17.

Moreover, a single fitting 13 is sufficient for feeding pressurized fuel into both control chamber 8 and injection chamber 3.

Plunger 1 is guided extremely accurately by top portion 29 connected in sliding manner inside sleeve 16, the sliding surfaces of which may be ground with no difficulty whatsoever. Correct angular positioning of nozzle 5 in relation to body 2 is achieved solely by means of pin 32 housed inside easily-formable cavities. Valve 6 provides for accurately metering the amount of fuel injected at each cycle, by virtue of spring 45 guiding anchor 40 during its movement, and by virtue of spacer 47 preventing anchor 40 from directly contacting and adhering to core 41.

The injector according to the present invention is extremely compact, especially radially, and may be connected quickly and easily to the injection pump by virtue of featuring only one fitting.

To those skilled in the art it will be clear that changes may be made to both the design and arrangement of the component parts of the injector as described and illustrated herein without, however, departing from the scope of the present invention.

We claim:

1. A diesel engine electromagnetic fuel injector comprising:

a plunger sliding inside an injector body, for controlling fuel passage between an injection chamber, supplied with the fuel under pressure, and at least one injection orifice formed in an injection nozzle secured to said body;

an electromagnetic fuel metering valve for controlling fuel passage, through a drain orifice, between a control chamber, supplied with the fuel under pressure, and a low-pressure chamber, also as to reduce the pressure of the fuel in said control chamber by draining the fuel through said drain orifice; and a plurality of sleeves including a top sleeve, and intermediate sleeve, and a bottom sleeve, said intermediate sleeve housing a spring coaxial with said plunger and designed to secure said plunger in a position wherein said plunger closes said injection orifice;

surface portions of said plunger being exposed to the fuel inside said injection chamber and said control chamber, so that the pressures inside said chambers and acting on said surface portions displace said plunger when the pressure in said control chamber falls to a given valve;

said fuel under pressure being supplied to said injection chamber and said control chamber by means of a single fitting connected to a supply pipe, said fitting communicating with a supply orifice formed in said body, said supply orifice, communicating with said control chamber and with a supply duct for feeding fuel into said injection chamber;

said duct for supplying fuel to said injection chamber comprising an annular cavity formed in said body, coaxial with an axial hole formed in said body and inside which said plunger slides axially, and said fuel supply orifice terminating inside said annular cavity; an axial groove formed in said top sleeve; a first annular chamber formed between said tap and intermediate sleeves and said body; and at least one radially hole formed in said intermediate sleeve.

2. The injector of claim 1 wherein said bottom sleeve is also housed inside a cavity on said injection nozzle; said nozzle being positioned angularly in relation to said body by means of a radial pin inserted between said bottom sleeve, said body, and said nozzle and an annular elastic element disposed between said bottom sleeve and said intermediate sleeve.

3. A diesel engine electromagnetic fuel injector comprising:

a plunger sliding inside an injector body, for controlling fuel passage between an injection chamber, supplied with the fuel under pressure, and at least one injection orifice formed in an injection nozzle secured to said body; and an electromagnetic fuel metering valve for controlling fuel passage, through a drain orifice, between a control chamber, supplied with the fuel under pressure, and a low-pressure chamber, so as to reduce the pressure of the fuel in said control chamber by draining the fuel through said drain orifice;

said electromagnetic metering valve including a mobile plugging member for controlling fuel passage through said drain orifice from said control chamber to said low-pressure chamber, and which is activated by a disc-shaped anchor attracted by an electromagnet core and loaded by a spring located between said core and said anchor and exerting force on said anchor in the opposite direction to that exerted by said electromagnet; said electromagnetic metering valve further including a second helical spring located between said anchor and said body, coaxial with said anchor, and designed to exert pressure on and guide said anchor during its movement;

surface portions of said plunger being exposed to the fuel inside said injection chamber and said control chamber, so that the pressures inside said chambers and acting on said surface portions displace said plunger when the pressure in said control chamber falls to a given value;

said fuel under pressure being supplied to said injection chamber and said control chamber by means of a single fitting connected to a supply pipe and fitting communicating with a supply orifice formed in said body, said supply orifice communicating with said control chamber and with a supply duct for feeding fuel into said injection chamber.

4. The injector of claim 3 further comprising an annular spacer between said anchor and said core for preventing the surface of said anchor facing said core from contacting the corresponding surface of said core.

5. A diesel engine electromagnetic fuel injector comprising:

a plunger sliding inside an injector body, for controlling fuel passage between an injection chamber, supplied with the fuel under pressure, and at least one injection orifice formed in an injection nozzle secured to said body;

an electromagnetic fuel metering valve for controlling fuel passage, through a drain orifice, between a control chamber, supplied with the fuel under pressure, and a low-pressure chamber, so as to reduce the pressure of the fuel in said control chamber by draining the fuel through said drain orifice;

surface portions of said plunger being exposed to the fuel inside said injection chamber and said control chamber, so that the pressures inside said chambers and acting on said surface portions displace said plunger when the pressure in said control chamber falls to a given valve;

said fuel under pressure being supplied to said injection chamber and said control chamber by means of a single fitting connected to a supply pipe, said fitting communicating with, a supply orifice formed in said body, said supply orifices communicating with said control chamber and with a supply duct for feeding fuel into said injection chamber;

said supply duct being formed substantially inside a plurality of sleeves housed in an axial hole in said body and inside which said plunger slides axially, said plunger being connected in sliding manner inside an uppermost one f said sleeves; and a seal disposed between said top sleeve and said body.

* * * * *

UNITED STATES PATENT AND TRADEMARK OFFICE

CERTIFICATE OF CORRECTION

PATENT NO. : 5,067,658

DATED : November 26, 1991

INVENTOR(S) : Sisto L. DeMattheis & Mario Sfarzetta

It is certified that error appears in the above-identified patent and that said Letters Patent is hereby corrected as shown below:

Claim 1, column 4, line 52, delete "and" and insert --an--;
Claim 1, column 4, line 63, delete "valve" and insert --value--;
Claim 1, column 5, line 9, delete "tap" and insert --top--;
Claim 1, column 5, line 11, delete "radially" and insert --radial--.
Claim 3, column 6, line 7, delete "and" and insert --, said--
Claim 5, column 6, line 34, delete "valve" and insert --value--
Claim 5, column 6, line 38, delete ","
Claim 5, column 6, line 46, delete "f" and insert --of--.

Signed and Sealed this

Sixth Day of April, 1993

*Attest:*

STEPHEN G. KUNIN

*Attesting Officer*

*Acting Commissioner of Patents and Trademarks*